US006258590B1

(12) United States Patent
Lange et al.

(10) Patent No.: US 6,258,590 B1
(45) Date of Patent: Jul. 10, 2001

(54) BIOPREPARATION OF TEXTILES AT HIGH TEMPERATURES

(75) Inventors: Niels Erik Krebs Lange, Raleigh, NC (US); Lars Kongsbak, Holte (DK); Martin Shülein, Copenhagen Ø (DK); Mads Eskelund Bjørnvad, Frederiksberg (DK); Philip Anwar Husain, Wake Forest, NC (US)

(73) Assignees: Novozymes A/S, Bagsvaerd (DK); Novozymes North America, Franklinton, NC (US)

( * ) Notice: Subject to any disclaimer, the term of this patent is extended or adjusted under 35 U.S.C. 154(b) by 0 days.

(21) Appl. No.: 09/184,217

(22) Filed: Nov. 2, 1998

(51) Int. Cl.[7] ..... D06M 16/00; C12N 9/88

(52) U.S. Cl. ..... 435/263; 8/137; 8/139; 435/232

(58) Field of Search ..... 8/139, 137; 435/263, 435/232

(56) References Cited

U.S. PATENT DOCUMENTS 5,912,407 * 6/1999 Miller et al. ..... 8/139

FOREIGN PATENT DOCUMENTS 0 870 834 A1 10/1998 (EP) .
WO 98/24965 6/1998 (WO) .
WO 99/27084 6/1999 (WO) .

* cited by examiner

*Primary Examiner*—Herbert J. Lilling
(74) *Attorney, Agent, or Firm*—Elian J. Lambris, Esq.; Jason I. Garbell, Esq.

(57) ABSTRACT

The present invention provides methods for higha-temperature biopreparation of cellulosic fibers by contacting the fibers with pectin-degrading enzymes, preferably thermostable, alkaline, divalent cation-independent pectate lyases, under conditions compatible with scouring and bleaching technologies.

7 Claims, 2 Drawing Sheets

Contour plot showing % residual pectin at different combinations of pH and temperature at an enzyme dosage of 100 μmol/min/kg fiber Influence of pectate lyase dosage on % residual pectin at pH 9 and 80°C

BIOPREPARATION OF TEXTILES AT HIGH TEMPERATURES

FIELD OF THE INVENTION

The present invention relates to methods for biopreparation of cellulosic fibers, particularly textiles and most particularly cotton fabrics, at high temperatures using thermostable pectate lyases.

BACKGROUND OF THE INVENTION

An important aspect of the preparation of textiles from cellulosic fibers is the removal of non-cellulosic components found in the native fiber, as well as the removal of impurities, such as compounds added to the fiber as sizing and lubricants used in the processing machinery. The removal of non-cellulosic impurities, termed "scouring", optimally results in a fabric with a high and even wettability that, consequently, can be evenly bleached and/or dyed.

Conventional scouring processes typically utilize highly alkaline chemical treatment, which results not only in removal of impurities but also in weakening of the underlying cellulose component of the fiber or fabric. Furthermore, chemical scouring creates environmental problems in effluent disposal, due to the chemicals employed and the materials extracted from the fibers. Consequently, there is a need in the art for scouring methods that are specifically targeted to removal of impurities and that are environmentally friendly.

Enzymatic scouring of textiles has been performed using multicomponent fungal enzyme systems comprising pectinases and cellulases that are active at a pH of about 4–5 (Bach et al., *Textilveredlung* 27:2, 1992; Bach et al., *Textilpraxis International,* March 1993, p. 220–225; Rössner, *Melliand Textilberichte* 2:144,1993; Rössner, *Textilveredlung* 30:82,1995; Hardin et al., 1997 *Proceedings Beltwide Cotton Conferences,* pp. 745–747; Li et al., *Textile Chemist and Colorist* 29:71, 1997; Li et al., 1997 *International Conference & Exhibition* (*AATCC*), pp. 444–454). In these studies, only a small proportion of the total enzyme activity in the preparations is useful for scouring. These methods thus require the use of large amounts of the enzyme preparation, making them economically unfeasible. Bacterial pectinases, sometimes combined with hemicellulases such as arabinanase, have also been used; these enzymes are typically active at higher pHs (International Patent Application WO9802531; Sakai et al., *Textile Engineering* (in Japanese), 45:301, 1992; Japanese patent 6220772; Sakai, *Dyeing Industry* (in Japanese) 43:162, 1995). All reported bacterial pectinases, however, require divalent cations for activity and are not generally active at temperatures over 60° C. These properties limit their application to bioscouring of textiles, since (i) the textiles must be pre-boiled to attenuate the waxy cuticle overlaying the pectin layer and (ii) calcium ions tend to form insoluble salts which precipitate on the surface of the fibers.

Thus, there is a need in the art for bioscouring methods that can be performed in a single step, at temperatures near or above the melting temperature of the waxy cuticle of cotton (70° C.) and in the absence of added divalent cations, using enzymes that effectively remove pectin and thereby facilitate the removal of pectin and other non-cellulosic impurities.

SUMMARY OF THE INVENTION

The present invention provides methods for treating cellulosic fibers to remove non-cellulosic compounds. The methods are carried out by contacting the fibers with an enzyme having pectin-degrading activity, preferably pectate lyase activity, at high temperatures, under conditions that result in pectin removal. Preferably, at least about 30% by weight of the pectin in the fibers is removed; more preferably, at least about 50%, and most preferably, at least about 70%, is removed. The contacting is preferably performed at a temperature above about 70° C.; most preferably, above about 80° C. In preferred embodiments, the contacting is performed (i) at a pH of at least about 7; more preferably, at least about 8; and most preferably, at least about 9; and (ii) in the absence of added divalent cations.

Pectin-degrading enzymes useful for practicing the invention include without limitation those that (i) exhibit maximal pectate lyase enzymatic activity at a temperature above about 70° C., preferably above about 80° C.; (ii) exhibit maximal activity at a pH above about 8, preferably above about 9; and (iii) exhibit enzymatic activity that is independent of the presence of divalent cations. It will be understood that any pectate lyase may be used that is sufficiently active above about 70° C. to remove at least about 30% by weight of the pectin in the fiber.

In one series of embodiments, the methods use a thermostable pectate lyase comprising a polypeptide having at least 70% homology to the amino acid sequence of SEQ ID NO:1. In preferred embodiments, the thermostable pectate lyase comprises the amino acid sequence of SEQ ID NO:1. See, e.g., Example 2 below. The plasmid comprising DNA encoding SEQ ID NO:1 has been trrmsformed into a strain of *E. coli* and a bacterial clone containing the plasmid was deposited according to the Budapest Treaty at the Deutsche Sammlung von Mikroorganismen und Zellkulturen GmbH on Sep. 8, 1998, under deposit number DSM 12404.

In another series of embodiments, the methods use a pectate lyase comprising a polypeptide having at least 70% homology to the amino acid sequence of SEQ ID NO:2 of co-pending U.S. patent application Ser. No. 09/073,684, filed May 6, 1998. See, e.g., Example 2 below.

Pectate lyases for use in the present invention are preferably derived from Bacillus species, more preferably from *B. licheniformis, B. agaradhaerens, B. alcalophilus, B. pseudoalcalophilus, B. clarkii, B. halodurans, B. lentus, B. causii, B. gibsonii,* or related Bacillus species. Variant pectate lyases derived from any pectate lyase polypeptide may also be used in practicing the invention, so long as they exhibit thermostable pectate lyase enzymatic activity, which is preferably alkaline and/or divalent cation-independent.

The methods of the invention can be used for treating crude fibers, yarn, or woven or knit textiles. The fibers may be cotton, linen, flax, ramie, rayon, or blends of these fibers with each other or with other natural or synthetic fibers. The non-cellulosic compounds that are removed using the methods of the invention may be compounds derived from the fiber or compounds derived from manufacturing processes, such as, e.g., spinning, coning, or slashing lubricants.

In some embodiments, the invention further comprises contacting the fibers with one or more other enzymes, including, without limitation, proteases, pectin-degrading enzymes, and lipases.

In another aspect, the invention provides a method for textile preparation which comprises subjecting the textile to simultaneous or sequential (i) scouring and (ii) bleaching, wherein the scouring comprises contacting the textile with an enzyme having thermostable pectate lyase activity, under conditions that result in removal of at least about 30% by weight of the pectin in the textile. In some embodiments, the scouring and bleaching steps are performed simultaneously. The textile may also be subjected to desizing, dyeing, and/or biopolishing using other enzymes.

The present invention provides advantages over conventional scouring processes, including: (i) shorter processing times; (ii) more efficient emulsification and removal of waxes; and (iii) full compatibility with existing state-of-the-art textile processing technologies, including, e.g., continuous pad steam systems.

DETAILED DESCRIPTION OF THE INVENTION

Figure 1:
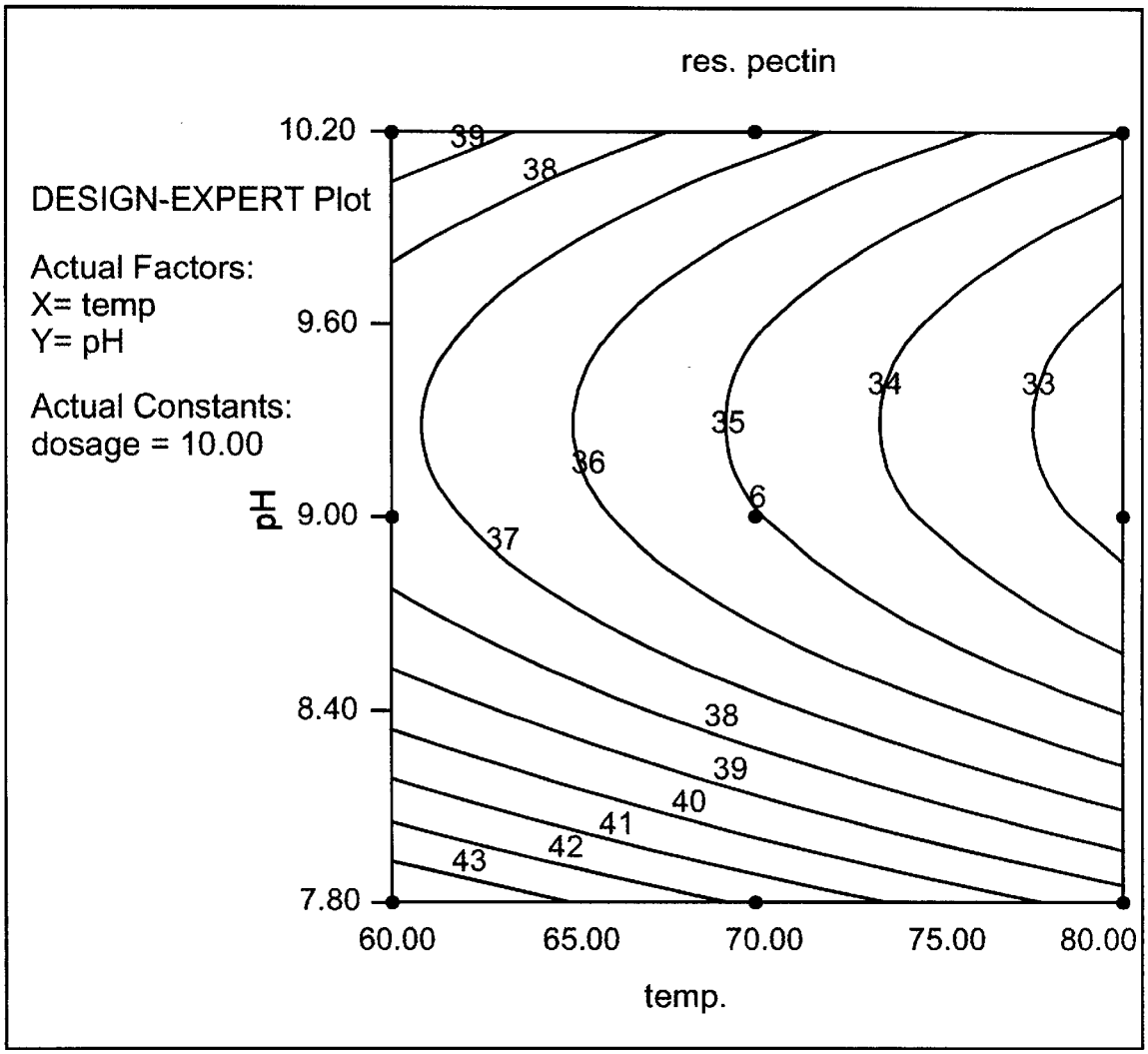
FIG. 1 is a graphic illustration of the effect of pH and temperature on the removal of pectin from a cotton fabric using a thermostable pectate lyase. The removal of pectin is expressed as % residual pectin. The pectate lyase was applied to the fabric at a dosage of 100 $\mu$mol/min/kg fabric.

The present invention provides methods for treating cellulosic fibers to remove non-cellulosic compounds. The methods are carried out by contacting the fibers with a pectin-degrading enzyme, preferably an enzyme having thermostable pectate lyase activity, under conditions that result in removal of pectin from the fiber. The methods of the invention can be used for biopreparation of textiles, particularly for scouring, to produce a textile having desirable properties such as a uniformly high wettability. The non-cellulosic compounds that are removed using the methods of the invention can be those derived from the natural fiber itself, including without limitation pectin and waxy cuticle, as well as non-cellulosic compounds derived from manufacturing processes, including without limitation spinning, coning, and slashing lubricants.

Thermostable Pectate Lyases

The present invention is based on the discovery of thermostable pectate lyases that are enzymatically active under conditions of temperature, pH, and ionic composition that are compatible with textile preparation techniques. Pectate lyase enzymatic activity as used herein refers to catalysis of the random cleavage of $\alpha$-1,4-glycosidic linkages in pectic acid (also called polygalcturonic acid) by transelimination. Pectate lyases generally belong to the enzyme class EC 4.2.2.2 and are also termed polygalacturonate lyases and poly(1,4-$\alpha$-D-galacturonide) lyases. For purposes of the present invention, pectate lyase enzymatic activity is the activity determined by measuring the increase in absorbance at 235 nm of a 0.1% w/v solution of sodium polygalacturonate in 0.1M glycine buffer at pH 10. Enzyme activity is typically expressed as x $\mu$mol/min, i.e., the amount of enzyme that catalyzes the formation of x $\mu$mole product/min. An alternative assay measures the decrease in viscosity of a 5% w/v solution of sodium polygalacturonate in 0.1M glycine buffer at pH 10, as measured by vibration viscometry (APSU units). Both assays for pectate lyase enzymatic activity are described in more detail below.

As used herein, a "thermostable" pectate lyase is an enzyme that exhibits maximal pectate lyase enzymatic activity at a temperature above about 70° C. An "alkaline" pectate lyase is an enzyme that exhibits maximal pectate lyase enzymatic activity at a pH above about 7. A "divalent-cation independent" pectate lyase is an enzyme whose pectate lyase enzymatic activity is essentially unaffected by divalent cations such as, e.g., calcium ions.

The methods of the invention encompass the use of any pectate lyase that exhibits enzymatic activity at a temperature above about 70° C., preferably above about 80° C., and most preferably above about 85° C., sufficient to degrade at least about 30% of the pectin in a cellulosic fiber. Preferably, the methods utilize an enzyme that exhibits maximal activity at these high temperatures. In addition, thermostable pectate lyases useful for practicing the invention may also (i) exhibit maximal activity at pHs above about 8, preferably above about 9, and most preferably above about 10 and (ii) exhibit enzymatic activity in the absence of added divalent cations such as calcium ions. These properties make the pectate lyases particularly suitable for use in bioscouring methods according to the present invention.

Non-limiting examples of thermostable pectate lyases whose use is encompassed by the present invention include polypeptides comprising the sequence of SEQ ID NO:1 and polypeptides comprising amino acid sequences having at least about 60% homology, preferably at least about 70% homology, more preferably at least about 80% homology, and most preferably at least about 90% homology with SEQ ID NO:1. Homology can be determined using algorithms known in the art, including, without limitation, the GAP program (GCG, Madison Wis.), using a GAP creation penalty of 3.0 and a GAP extension penalty of 0.1.

In preferred embodiments, the thermostable pectate lyase comprises the amino acid sequence of SEQ ID NO:1. See, e.g., Example 2 below. The plasmid comprising DNA encoding SEQ ID NO:1 has been transformed into a strain of *E. coli* and a bacterial clone containing the plasmid was deposited according to the Budapest Treaty at the Deutsche Sammlung von Mikroorganismen und Zellkulturen GmbH on Sep. 8, 1998, under deposit number DSM 12404.

In another series of embodiments, the methods use a pectate lyase comprising a polypeptide having at leastabout 70% homology, preferably at least about 80% homology, and most preferably at least about 90% homology, to the amino acid sequence of SEQ ID NO:2 of co-pending U.S. patent application Ser. No. 09/073,684, filed May 6, 1998. See, e.g., Example 2 below.

It will be understood that any polypeptide exhibiting the properties described above may be used in practicing the invention. That is, pectate lyases derived from other organisms, or pectate lyases derived from the enzymes listed above in which one or more amino acids have been added, deleted, or substituted, including hybrid polypeptides, may be used, so long as the resulting polypeptides exhibit the high-temperature activity (and, preferably, the pH optima and divalent cation independence of activity) described above. Such pectate lyase variants useful in practicing the present invention can be created using conventional mutagenesis procedures and identified using, e.g., high-throughput screening techniques such as the agar plate screening procedure described in Example 1 below.

Determination of temperature, pH, and divalent cation dependence of an isolated pectate lyase be achieved using conventional methods. For example, an enzymatic activity assay (such as, e.g., the spectroscopic assay described in Example 1 below) is performed at a range of temperatures and pHs and in the presence and absence of different concentrations of $Ca^{++}$, and the temperature and pH optima and divalent cation effect (if any) are quantified. pH, temperature, and cation dependence are then determined to establish the suitability of a particular pectate lyase for use in the present invention.

Pectate lyases for use in the invention may be derived from their cell of origin or may be recombinantly produced, and may be purified or isolated. As used herein, "purified" or "isolated" pectate lyase is pectate lyase that has been treated to remove non-pectate lyase material derived from the cell in which it was synthesized that could interfere with its enzymatic activity. Typically, the pectate lyase is separated from the bacterial or fungal microorganism in which it is produced as an endogenous constituent or as a recombinant product. If the pectate lyase is secreted into the culture medium, purification may comprise separating the culture medium from the biomass by centrifugation, filtration, or precipitation, using conventional methods. Alternatively, the pectate lyase may be released from the host cell by cell disruption and separation of the biomass. In some cases, further purification may be achieved by conventional protein purification methods, including without limitation ammonium sulfate precipitation; acid or chaotrope extraction; ion-exchange, molecular sieve, and hydrophobic chromatography, including FPLC and HPLC; preparative isoelectric focusing; and preparative polyacrylamide gel electrophoresis. Alternatively, purification may is be achieved using affinity chromatography, including immunoaffinity chromatography. For example, hybrid recombinant pectate lyases may be used having an additional amino acid sequence that serves as an affinity "tag", which facilitates purification using an appropriate solid-phase matrix.

The pectate lyases used in the methods of the invention may be chemically modified to enhance one or more properties that render them even more advantageous, such as, e.g., increasing solubility, decreasing lability or divalent ion dependence, etc. The modifications include, without limitation, phosphorylation, acetylation, sulfation, acylation, or other protein modifications known to those skilled in the art.

Bioprevaration Methods

According to the present invention, non-cellulosic components are removed from a cellulosic fiber by contacting the fiber with one or more of the thermostable pectate lyases described above under conditions that allow effective scouring. "Scouring" as used herein refers to the removal of non-cellulosic components from a cellulosic fiber. Effective scouring typically results in a wettability of less than about 10 seconds, preferably less than about 5 seconds, and most preferably less than about 2 seconds, when measured using the drop test according to AATCC Test Method 39-1980.

Typically, effective scouring according to the invention requires the digestion of a substantial proportion of the pectin in the fiber, preferably at least 30% by weight, more preferably at least 50% by weight, and most preferably at least 70%. Pectin digestion refers to cleavage of α-1,4-glycosidic linkages in pectin so that the digestion products can be removed from the fiber by, e.g., rinsing or any other conventional separation method. Methods for measuring the degree of pectin digestion of a fiber include, without limitation, the Ruthenium Red staining method as described by Luft, *The Anatomical Record* 171:347, 1971.

"Cellulosic fiber" as used herein refers without limitation to cotton, linen, flax, ramie, rayon, and their blends. The fiber may comprise without limitation crude fiber, yarn, woven or knit textile or fabric, or a garment or finished product.

In practicing the invention, cellulosic fibers are contacted with an aqueous solution or wash liquor containing a thermostable pectate lyase as described above. The concentration of enzyme in the aqueous solution is adjusted so that the dosage of enzyme added to a given amount of fiber (i.e., μmol/min/kg fiber) is between about 0.1 and about 10,000, preferably between about 1 and about 2,000, and most preferably between about 10 and about 500.

The aqueous solution containing the enzyme preferably has a pH of about 9.0 or higher, most preferably about 10.0 or higher, and either contains a low concentration of added calcium, i.e., less than 2 mM $Ca^{++}$, or lacks added $Ca^{++}$ entirely.

To achieve effective scouring, the dosage of enzyme (μmol/min/kg fiber), the concentration of enzyme in the wash liquor (μmol/min/L wash liquor), and the total volume of wash liquor applied to a given amount of fiber (L/kg fiber) will vary, depending on:

(i) the nature of the fiber, i.e., crude fiber, yarn, or textile;

(ii) the particular pectate lyase enzyme used, and the specific activity of the enzyme;

(iii) the conditions of temperature, pH, time, etc., at which the processing occurs;

(iii) the presence of other components in the wash liquor; and (iv) the type of processing regime used, i.e., continuous, discontinuous pad-batch, or batch.

Determination of suitable enzyme dosage, enzyme concentration, and volume of solution to be used can be achieved using only routine experimentation by establishing a matrix of conditions and testing different points in the matrix. For example, the amount of enzyme, the temperature at which the contacting occurs, and the total time of processing can be varied, after which the resulting fiber or textile is evaluated for (a) pectin removal and/or (b) a scoured property such as, e.g., wettability.

In preferred embodiments, the fiber is contacted with the enzyme under the following conditions: (i) a temperature above about 70° C., preferably above about 80° C.; (ii) a pH above about 7.0, preferably above 8.0, and most preferably above about 9.5; (iii) the absence of added divalent cations; (iv) a wash liquor:fabric ratio of between about 0.5 and about 50; and (v) an enzyme dosage of between about 10 and about 500 μmol/min/kg fiber.

The manner in which the aqueous solution containing the enzyme is contacted with the cellulosic material will depend upon whether the processing regime is continuous, discontinuous pad-batch or batch. For continuous or discontinuous pad-batch processing, the aqueous enzyme solution is contained in a saturator bath and is applied continuously to the fabric as it travels through the bath, during which process the fabric typically absorbs the processing liquor at an amount of 0.5–1.5 times its weight. In batch operations, the fabric is exposed to the enzyme solution for a period ranging from about 5 minutes to 24 hours at a liquor-to-fabric ratio of 5:1-50:1.

Additional Biopreparation Processes

In some embodiments of the invention, the cellulosic material is exposed to a chemical treatment such as a bleaching process or a combined scouring/bleaching process comprising, for example, the use of hydrogen peroxide or other oxidizing agent. The action of the enzyme on the cellulosic material renders the fiber more responsive to a subsequent bleaching procedure, resulting in an enhanced whiteness response. Thus, the methods of the invention can produce a whiter material with the same level of bleaching chemicals or produce an equivalent whiteness using a decreased level of bleaching chemicals.

Additional Components

In some embodiments of the invention, the aqueous solution containing the thermostable pectate lyase further comprises other components, including without limitation other enzymes, as well as surfactants, bleaching agents, antifoaming agents, builder systems, and the like, that enhance the scouring process and/or provide superior effects related to, e.g., bleachability, strength, resistance to pilling, water absorbency, and dyeability.

Enzymes suitable for use in the present invention include without limitation:

(i) Pectin-digesting enzymes: Suitable pectin-digesting enzymes (some of which are identified by their Enzyme Classification numbers in accordance with the Recommendations (1992) of the International Union of Biochemistry and Molecular Biology (IUBMB)) include, without limitation, pectin-degrading enzymes such as pectin lyase (4.2.2.2), pectin methyl esterase, polygalacturonase (3.2.1.15), and rhamnogalacturonase (WO 92/19728); and hemicellulases such as endo-arabinanase (3.2.1.99, Rombouts et al., *Carb. Polymers* 9:25, 1988), arabinofuranosidase, endo-β-1,4-galactanase, and endo-xylanase (3.2.1.8).

(ii) Proteases: Suitable proteases include those of animal, vegetable or microbial origin, preferably of microbial origin. The protease may be a serine protease or a metalloprotease, preferably an alkaline microbial protease or a trypsinike protease. Examples of proteases include aminopeptidases, including prolyl aminopeptidase (3.4.11.5), X-pro aminopeptidase (3.4.11.9), bacterial leucyl aminopeptidase (3.4.11.10), thermophilic aminopeptidase (3.4.11.12), lysyl aminopeptidase (3.4.11.15), tryptophanyl aminopeptidase (3.4.11.17), and methionyl aminopeptidase (3.4.11.18); serine endopeptidases, including chymotrypsin (3.4.21.1), trypsin (3.4.21.4), cucumisin (3.4.21.25), brachyurin (3.4.21.32), cerevisin (3.4.21.48) and subtilisin (3.4.21.62); cysteine endopeptidases, including papain (3.4.22.2), ficain (3.4.22.3), chymopapain (3.4.22.6), asclepain (3.4.22.7), actinidain (3.4.22.14), caricain (3.4.22.30) and ananain (3.4.22.31); aspartic endopeptidases, including pepsin A (3.4.23.1), Aspergillopepsin I (3.4.23.18), Penicillopepsin (3.4.23.20) and Saccharopepsin (3.4.23.25); and metalloendopeptidases, including Bacillolysin (3.4.24.28).

Non-limiting examples of subtilisins include subtilisin BPN', subtilisin amylosac-chariticus, subtilisin 168, subtilisin mesentericopeptidase, subtilisin Carlsberg, subtilisin DY, subtilisin 309, subtilisin 147, thermitase, aqualysin, Bacillus PB92 protease, proteinase K, protease TW7, and protease TW3.

Commercially available proteases include Alcalase™, Savinase™, Primasel™, Duralase™, Esperase™, and Kannase™ (Novo Nordisk A/S), Maxatase™, Maxacal™, Maxapem™, Properase™, Purafect™, Purafect OxP™, FN2™, and FN3™ (Genencor International Inc.).

Also contemplated for use in the present invention are protease variants, such as those disclosed in EP 130.756 (Genentech), EP 214.435 (Henkel), WO 87/04461 (Amgen), WO 87/05050 (Genex), EP 251.446 (Genencor), EP 260.105 (Genencor), Thomas et al., (1985), Nature. 318, p. 375–376, Thomas et al., (1987), J. Mol. Biol., 193, pp. 803–813, Russel et al., (1987), Nature, 328, p. 496–500, WO 88/08028 (Genex), WO 88/08033 (Amgen), WO 89/06279 (Nove Nordisk A/S), WO 91/00345 (Nove Nordisk A/S), EP 525 610 (Solvay) and WO 94/02618 (Gist-Brocades N.V.).

The activity of proteases can be determined as described in "Methods of Enzymatic Analysis", third edition, 1984, Verlag Chemie, Weinheim, vol. 5.

(iii) Lipases: Suitable lipases (also termed carboxylic ester hydrolases) include those of bacterial or fungal origin, including triacylglycerol lipases (3.1.1.3) and Phospholipase $A_2$(3.1.1.4.). Lipases for use in the present invention include, without limitation, lipases from Humicola (synonym Theronnmyces), such as from *H. lanuginosa* (*T. lanuginosus*) as described in EP 258 068 and EP 305 216 or from *H. insolens* as described in WO 96/13580; a Pseudomonas lipase, such as from *P. alcaligenes* or *P. pseudoalcaligenes* (EP 218 272), *P. cepacia* (EP 331 376), *P. stutzeri* (GB 1,372,034), *P. fluorescens, Pseudomonas sp.* strain SD 705 (WO 95/06720 and WO 96/27002), *P. wisconsinensis* (WO 96/12012); a Bacillus lipase, such as from *B. subtilis* (Dartois et al., *Biochem.Biophys. Acta,* 1131:253–360, 1993), *B. stearothermophilus* (JP 64/744992) or *B. pumilus* (WO 91/16422). Other examples are lipase variants such as those described in WO 92/05249, WO 94/01541, EP 407 225, EP 260 105, WO 95/35381, WO 96/00292, WO 95/30744, WO 94/25578, WO 95/14783, WO 95/22615, WO 97/04079 and WO 97/07202. Preferred commercially available lipase enzymes include Lipolase™ and Lipolase Ultra™, Lipozyme™, Palatase™, Novozym™435, and Lecitase™ (all available from Novo Nordisk A/S). The activity of the lipase can be determined as described in "Methods of Enzymatic Analysis", Third Edition, 1984, Verlag Chemie, Weinhein, vol. 4.

Preferably, the enzymes are derived from alkalophilic microorganisms and/or exhibit enzymatic activity at elevated temperatures. The enzymes may be isolated from their cell of origin or may be recombinantly produced, and may be chemically or genetically modified. Typically, the enzymes are incorporated in the aqueous solution at a level of from about 0.0001% to about 1% of enzyme protein by weight of the composition, more preferably from about 0.001% to about 0.5% and most preferably from 0.01% to 0.2%. It will be understood that the amount of enzymatic activity units for each additional enzyme to used in the methods of the present invention in conjunction with a particular thermostable pectate lyase can be easily determined using conventional assays.

Surfactants suitable for use in practicing the present invention include, without limitation, nonionic (U.S. Pat. No. 4,565,647); anionic; cationic; and zwitterionic surfactants (U.S. Pat. No. 3,929,678); which are typically present at a concentration of between about 0.2% to about 15% by weight, preferably from about 1% to about 10% by weight. Anionic surfactants include, without limitation, linear alkylbenzenesulfonate, α-olefmsulfonate, alkyl sulfate (fatty alcohol sulfate), alcohol ethoxysulfate, secondary alkanesulfonate, alpha-sulfo fatty acid methyl ester, alkyl- or alkenylsuccinic acid, and soap. Non-ionic surfactants include, without limitation, alcohol ethoxylate, nonylphenol ethoxylate, alkylpolyglycoside, alkyldirnethylamineoxide, ethoxylated fatty acid monoethanolamide, fatty acid monoethanolamide, polyhydroxy alkyl fatty acid amide, and N-acyl N-alkyl derivatives of glucosamine ("glucamides").

Builder systems include, without limitation, aluminosilicates, silicates, polycarboxylates and fatty acids, materials such as ethylenediamine tetraacetate, and metal ion sequestrants such as aminopolyphosphonates, particularly ethylenediamine tetramethylene phosphonic acid and diethylene triamine pentamethylenephosphonic acid, which are included at a concentration of between about 5% to 80% by weight, preferably between about 5% and about 30% by weight.

Bleaching systems may comprise a $H_2O_2$ source such as perborate or percarbonate, which may be combined with a peracid-forming bleach activator such as tetraacetylethylenediamine or nonanoyloxybenzenesulfonate. Alternatively, the bleaching system may comprise peroxyacids of, e.g., the amide, imide, or sulfone type.

Antifoam agents include without limitation silicones (U.S. Pat. No. 3,933,672; DC-544 (Dow Corning), which are typically included at a concentration of between about 0.01% and about 1% by weight.

The compositions may also contain soil-suspending agents, soil-releasing agents, optical brighteners, abrasives, andlor bactericides, as are conventionally known in the art.

The following are intended as non-limiting illustrations of the present invention.

EXAMPLE 1

Determination of Properties of Thermostable Pectate Lyases

The following methods are used to characterize pectate lyase enzymatic activity.

1. Pectate Lyase Assay

For this assay, a 0.1% sodium polygalacturonate (Sigma P-1879) solution is prepared in in 0.1 M glycine buffer, pH 10. 4 ml of this solution are preincubated for 5 min at 40° C. Then, 250 μl of the enzyme (or enzyme dilution) are added, after which the reaction is mixed for 10 sec on a mixer at the highest speed and incubated for 20 min at 40° C. or at another temperature, after which the absorbance at 235 nm is measured using a 0.5 ml cuvette with a 1 cm light path on a HP diode array spectrophotometer in a temperature controlled cuvette holder with continuous measurement of the absorbance at 235 nm. For steady state a linear increase for at least 200 sec was used for calculation of the rate.

For calculation of the catalytic rate, an increase of 5.2 $A_{235}$ per min corresponds to formation of 1 μmol of unsaturated product (Nasuna et al., *J. Biol. Chem,* 241:5298–5306, 1966; and Bartling et al., *Microbiology,* 141:873–881, 1995).

2. Alkaline APSU Assay

The APSU assay measures the change in viscosity of a solution of polygalacturonic acid in the absence of added calcium ions. A 5% wlv solution of sodium polygalacturonate (Sigma P-1879) is solubilised in 0.1 M glycine buffer, pH 10. 4 ml of this solution are preincubated for 5 min at 40° C. Then, 250 μl of the enzyme (or enzyme dilution) are added, after which the reaction is mixed for 10 sec on a mixer at the highest speed and incubated for 20 min at 40° C. or at another temperature.

Viscosity is measured using a MIVI 600 viscometer (Sofraser, 45700 Villemandeur, France). Viscosity is measured as mV after 10 sec. For calculation of APSU units the following standard curve is used:

| APSU/ml | mV |
|---|---|
| 0.00 | 300 |
| 4.00 | 276 |

-continued

| APSU/ml | mV |
|---|---|
| 9.00 | 249 |
| 14.00 | 227 |
| 19.00 | 206 |
| 24.00 | 188 |
| 34.00 | 177 |
| 49.00 | 163 |
| 99.00 | 168 |

3. Agar Assay

Pectate lyase activity can be measured by applying a test solution to 4 mm holes punched out in agar plates (such as, for example, LB agar), containing 0.7% w/v sodium polygalacturonate (Sigma P 1879). The plates are then incubated for 6 h at a particular temperature (such as, e.g., 75° C.). The plates are then soaked in either (i) 1M $CaCl_2$ for 0.5 h or (ii) 1% mixed alkyl trimethylammonium Br (MTAB, Sigma M-7635) for 1 h. Both of these procedures cause the precipitation of polygalacturonate within the agar. Pectate lyase activity can be detected by the appearance of clear zones within a background of precipitated polygalacturonate. Sensitivity of the assay is calibrated using dilutions of a standard preparation of pectate lyase.

EXAMPLE 2

Treatment of Cotton Fabric with Thermostable Pectate Lyases

The following experiments were performed to evaluate the use of thermostable pectate lyase to scour textiles.

A. Materials

1) Fabric: A woven army carded cotton sateen greige, quality 428R (242 g/m$^2$) was used.

2) Equipment: A Labomat (Mathis, Switzerland) was used at a liquor ratio of 12.5:1 (12 g fabric in 150 ml buffer/enzyme solution).

3) Pectate lyase: In Experiment 1, a pectate lyase corresponding to SEQ ID NO:1 was used, formulated in a solution containing 0.02 M phosphate buffer and 0.4 g/L non-ionic surfactant (Tergitol 15-S-12 from Union Carbide). In Experiment 2, a pectate lyase corresponding to SEQ ID NO:2 of co-pending U.S. patent application Ser. No. 09/073,684 was used, formulated in a solution containing 0.05 M phosphate/borate buffer, in 2.0 g/L non-ionic surfactant (Tergitol 15-S-12 from Union carbide), and 1.0 g/L wetter (Dioctyl sulfosuccinate).

B. Procedures and Results

In Experiment 1, the test fabrics were contacted with the aqueous solution containing the pectate lyase for 15 minutes at temperatures ranging between 60–80° C. and pHs ranging between 7–11, after which residual pectin was quantified.

Figure 2:
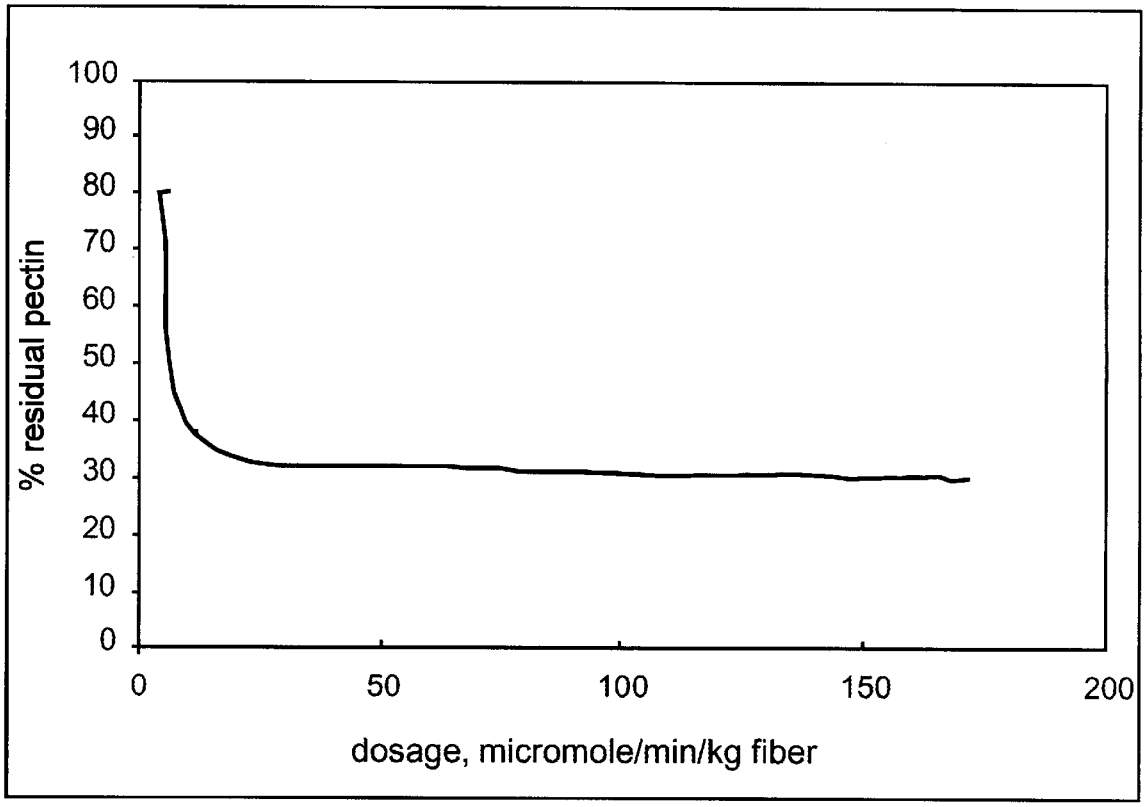
FIG. 2 is a graphic illustration of the effect of the dosage of thermostable pectate lyase on removal of pectin from a cotton fabric. The removal of pectin is expressed as % residual pectin, and the dosage as $\mu$mol/min/kg fiber. The pectate lyase was applied to the fabric at pH 9 and 80° C.

FIG. 1 shows a contour plot of the % residual pectin as a function of both pH and temperature, and FIG. 2 shows the % residual pectin as a function of the enzyme dosage. The pH optimum for pectin removal was 9.2 and the temperature optimum was above 80° C.

In Experiment 2, the test fabrics were contacted with the aqueous solution containing the pectate lyase at 600APSU/kg cotton, squeezed in a roller system to give a solution pickup of 85%, and incubated for 60 minutes at temperatures between 40–70° C., after which residual pectin was quantified. The % residual pectin as a function of temperature is shown in the go Table below.

| Temperature (° C.) | Residual Pectin (%) |
|---|---|
| 40° C. | 35% |
| 55° C. | 28% |
| 70° C. | 40% |

All patents, patent applications, and literature references referred to herein are hereby incorporated by reference in their entirety.

Many variations of the present invention will suggest themselves to those skilled in the art in light of the above detailed description. Such obvious variations are within the full intended scope of the appended claims.

SEQUENCE LISTING

```
<160> NUMBER OF SEQ ID NOS: 1

<210> SEQ ID NO 1
<211> LENGTH: 335
<212> TYPE: PRT
<213> ORGANISM: bacillus sp.

<400> SEQUENCE: 1

Met Arg Lys Leu Leu Ser Met Met Thr Ala Leu Val Leu Met Phe Gly
 1               5                  10                  15

Ile Met Val Val Pro Ser Ile Ala Lys Gly Glu Ser Asp Ser Thr Met
            20                  25                  30

Asn Ala Asp Phe Ser Met Gln Gly Phe Ala Thr Leu Asn Gly Gly Thr
        35                  40                  45

Thr Gly Gly Ala Gly Gly Gln Thr Val Thr Val Ser Thr Gly Asp Glu
    50                  55                  60

Leu Leu Ala Ala Leu Lys Asn Lys Asn Ser Asn Thr Pro Leu Thr Ile
65                  70                  75                  80

Tyr Val Asn Gly Thr Ile Thr Pro Ser Asn Thr Ser Ala Ser Lys Ile
                85                  90                  95

Asp Ile Lys Asp Val Asn Asp Val Ser Ile Leu Gly Val Gly Thr Gln
            100                 105                 110

Gly Glu Phe Asn Gly Ile Gly Ile Lys Val Trp Arg Ala Asn Asn Ile
        115                 120                 125

Ile Leu Arg Asn Leu Lys Ile His His Val Asn Thr Gly Asp Lys Asp
    130                 135                 140

Ala Ile Ser Ile Glu Gly Pro Ser Lys Asn Ile Trp Val Asp His Asn
145                 150                 155                 160

Glu Leu Tyr Asn Ser Leu Asp Val His Lys Asp Tyr Tyr Asp Gly Leu
                165                 170                 175

Phe Asp Val Lys Arg Asp Ala Asp Tyr Ile Thr Phe Ser Trp Asn Tyr
            180                 185                 190

Val His Asp Ser Trp Lys Ser Met Leu Met Gly Ser Ser Asp Ser Asp
        195                 200                 205

Ser Tyr Asn Arg Lys Ile Thr Phe His Asn Asn Tyr Phe Glu Asn Leu
    210                 215                 220

Asn Ser Arg Val Pro Ser Ile Arg Phe Gly Glu Ala His Ile Phe Ser
225                 230                 235                 240

Asn Tyr Tyr Asn Gly Ile Asn Glu Thr Gly Ile Asn Ser Arg Met Gly
                245                 250                 255

Ala Lys Val Arg Ile Glu Glu Asn Leu Phe Glu Arg Ala Asn Asn Pro
            260                 265                 270

Ile Val Ser Arg Asp Ser Arg Gln Val Gly Tyr Trp His Leu Ile Asn
```

-continued

```
        275                 280                 285

Asn His Phe Thr Gln Ser Thr Gly Glu Ile Pro Thr Thr Ser Thr Ile
    290                 295                 300

Thr Tyr Asn Pro Pro Tyr Ser Tyr Gln Ala Thr Pro Val Gly Gln Val
305                 310                 315                 320

Lys Asp Val Val Arg Ala Asn Ala Gly Val Gly Lys Val Thr Pro
                325                 330                 335
```

What is claimd is:

1. A method for treating cellulosic fibers to remove non-cellulosic compounds, said method comprising contacting said fibers with an enzyme having thermostable pectate lyase activity selected from the group consisting of: (a) an enzyme which comprises the sequence of SEQ ID NO:1 and (b) an enzyme comprising an amino acid sequence at least about 90% homologous to SEQ ID NO:1, when homology is determined using GAP, with a GAP creation penalty of 3.0 and a GAP extension penalty of 0.1.

2. A method as defined in claim 1, wherein said contacting is performed at a temperature above about 70° C.

3. A method as defined in claim 2, wherein said contacting is performed at a temperature above about 80° C.

4. A method as defined in claim 1, wherein said enzyme exhibits maximal pectate lyase enzymatic activity at a temperature above about 70° C.

5. A method as defined in claim 1, wherein said fibers comprise a textile.

6. A method as defined in claim 5, wherein said textile is cotton.

7. A method as defined in claim 1, further comprising contacting said fibers with one or more enzymes selected from the group consisting of pectin-degrading enzymes, proteases, and lipases.

* * * * *